US006946225B2

(12) United States Patent
Buettner et al.

(10) Patent No.: US 6,946,225 B2
(45) Date of Patent: Sep. 20, 2005

(54) ELECTROPHOTOGRAPHIC ELEMENT PROTECTED FROM PHOTOFATIGUE INDUCED BY VISIBLE LIGHT

(75) Inventors: Albert V. Buettner, Rochester, NY (US); Dennis R. Fronheiser, Rochester, NY (US); Anne F. Lairmore, Hilton, NY (US); David S. Weiss, Rochester, NY (US); Jeffrey R. Murray, Palmyra, NY (US); Marie B. O'Regan, Santa Barbara, CA (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/200,699

(22) Filed: Jul. 22, 2002

(65) Prior Publication Data

US 2003/0054270 A1 Mar. 20, 2003

Related U.S. Application Data

(60) Provisional application No. 60/309,861, filed on Aug. 3, 2001.

(51) Int. Cl.[7] ..... G03G 5/047

(52) U.S. Cl. ..... 430/58.15; 430/58.05; 430/58.3; 430/58.4; 430/58.65; 430/58.75; 430/59.1; 430/59.2; 430/59.4; 430/59.6; 430/83

(58) Field of Search ..... 430/83, 58.3, 59.1, 430/59.2, 58.65, 59.6, 59.4, 58.4, 58.35, 58.15, 58.75, 58.8, 58.05

(56) References Cited

U.S. PATENT DOCUMENTS

| | | | | |
|---|---|---|---|---|
| 4,555,463 A | * | 11/1985 | Hor et al. | 430/96 |
| 4,840,860 A | | 6/1989 | Staudenmayer et al. | |
| 4,840,861 A | | 6/1989 | Staudenmayer et al. | |
| 4,865,934 A | | 9/1989 | Ueda et al. | 430/78 |
| 4,869,986 A | | 9/1989 | Riblett | |
| 4,869,987 A | | 9/1989 | Riblett | |
| 5,112,935 A | | 5/1992 | Yacobucci et al. | |
| 5,135,828 A | | 8/1992 | Yang et al. | |
| 5,190,840 A | | 3/1993 | Weiss et al. | |
| 5,882,830 A | * | 3/1999 | Visser et al. | 430/58.8 |
| 5,952,139 A | | 9/1999 | Takeuchi et al. | 430/66 |
| 6,002,901 A | * | 12/1999 | Hoshizaki et al. | 399/159 |
| 6,156,468 A | * | 12/2000 | Wehelie et al. | 430/65 |

FOREIGN PATENT DOCUMENTS

| | | | |
|---|---|---|---|
| DE | 198 45 457 A1 | | 4/1999 |
| JP | 62-30256 | * | 2/1997 |

OTHER PUBLICATIONS

American Chemical Society STN File Registry No. 59459–48–2, copyright 2005.*

American Chemical Society STN File Registry No. 6925–69–5, copyright 2005.*

American Chemical Society STN File Registry No. 116844–59–8, copyright 2005.*

Diamond, A.S. ed. *Handbook of Imaging Materials,* Marcel Dekker, NY (1991), pp 165–166.*

Diamond, A.S., ed, *Handbook of Imaging Materials,* Marcel Dekker, Inc., NY (1991), p. 415.*

*RCA Electro–Optics Handbook,* Technical Studies EOH–11 RCA Corporation, PA (1978), pp. 13–14.*

Japanese Patent Office English Abstract of JP 62–030256 (pub Feb. 8, 1987).

Derwent Abstract AN 1987–076580, XP–002222543 describing JP 62–030256, Nov. 1987.

Japanese Patet Office Partial Machine–Assisted Translation of JP 11–109666 (pub Apr. 1999).

* cited by examiner

*Primary Examiner*—Janis L. Dote
(74) *Attorney, Agent, or Firm*—Paul A. Leipold; Carl F. Ruoff

(57) ABSTRACT

A multi-active electrophotographic charge generation element comprises a conductive support, a charge generation layer (CGL) disposed on the conductive support, and a charge transport layer (CTL) disposed on the charge generation layer. The charge generation layer (CGL) includes a charge-generation material comprising an aggregated or crystalline form of a first dye or pigment and a first polymeric binder. The charge transport layer (CTL) comprises at least one charge-transport agent, a second dye or pigment having absorption in a selected spectral region that at least partially overlaps the absorption of a dissolved non-aggregated or non-crystalline form of the first dye or pigment, and a second polymeric binder. The second dye or pigment in the charge transport layer absorbs radiation in the selected spectral region that is incident on the charge transport layer, thereby shielding the charge generation layer from that radiation and mitigating visible radiation-induced photofatigue.

17 Claims, No Drawings

ELECTROPHOTOGRAPHIC ELEMENT PROTECTED FROM PHOTOFATIGUE INDUCED BY VISIBLE LIGHT

CROSS-REFERENCE TO RELATED APPLICATION

In accordance with 37 CFR §1.78(5), this application claims the benefit of copending provisional application Ser. No. 60/309,861 filed Aug. 3, 2001, for ELECTROPHOTOGRAPHIC ELEMENT PROTECTED FROM PHOTOFATIGUE INDUCED BY VISIBLE LIGHT.

FIELD OF THE INVENTION

The present invention relates to charge generating elements and, more particularly, to multi-active electrophotographic charge generation elements having improved resistance to photofatigue induced by visible light.

BACKGROUND OF THE INVENTION

In charge generating elements, incident light induces a charge separation across various layers of a multiple layer device. In an electrophotographic charge generating element, also referred to herein as an electrophotographic element, under the influence of an applied field, electron-hole pairs produced within a charge generating layer separate and move in opposite directions to reduce the potential between an electrically conductive layer and an opposite surface of the element. The surface charge forms a pattern of electrostatic potential, also referred to as an electrostatic latent image. The electrostatic latent image can be formed by a variety of means such as, for example, imagewise radiation-induced discharge of a uniform potential previously formed on the surface. Typically, the electrostatic latent image is developed by contacting it with an electrographic developer to form a toner image, which is then fused to a receiver. If desired, the latent image can be transferred to another surface before development, or the toner image can be transferred before fusing.

Electrophotographic elements can be of various types, including both those commonly referred to as single layer or single-active-layer elements and those referred to as multi-active layer or multiple-active-layer elements. Single-active-layer and multiactive layer elements and their preparation and use are described in, for example, U.S. Pat. Nos. 4,701,396; 4,666,802; 4,578,334; 4,719,163; 4,175,960; 4,514,481; and 3,615,414, the disclosures of which are incorporated herein by reference.

Single layer elements contain, in addition to an electrically conductive layer, a single photoconductive layer that is active both to generate and transport charges in response to exposure to actinic radiation. Multiactive elements contain, besides an electrically conductive layer, at least two active layers, at least one of these layers being capable of generating charge, i.e., electron/hole pairs, in response to exposure to actinic radiation, referred to as a charge-generation layer (CGL), and at least one layer capable of accepting and transporting charges generated by the CGL, referred to as a charge-transport layer (CTL). In a multiactive element, either the CGL or the CTL is in electrical contact with both the electrically conductive layer and the remaining CTL or CGL. The CGL contains a charge-generation material, the CTL a charge-transport agent. One or both the CGL and CTL may further include a polymeric binder. Multiactive elements may also include other layers such as, for example, adhesive interlayers, protective overcoats, charge blocking layers, and the like.

Stabilization of an electrophotographic element to the effects of ultraviolet and/or short wavelength blue light by the inclusion of additives and/or binder polymers that strongly absorb ultraviolet and short wavelength blue light has been described in, for example, U.S. Pat. Nos. 4,869,986 and 4,869,987. Absorption of the undesired light by the stabilizing materials prevents absorption by the CTL transport material and inhibits the undesired transport material photochemistry. The use of particular polyesters as binders in the CTL is also effective in mitigating the deleterious effects of exposure to ultraviolet radiation. Suitable binder polymers are described in U.S. Pat. Nos. 4,840,860; 4,840,861; 5,112,935; 5,135,828; and 5,190,840, the disclosures of which are incorporated herein by reference.

In addition to the just-mentioned ultraviolet and short-blue radiation-induced photofatigue, an electrophotographic element exposed to office lighting or other relatively high intensity light sources may undergo undesirable changes in electrophotographic characteristics, for example, increased dark decay of the surface potential and increased residual potential caused by electrophotographic cycling. Increased dark decay, which can produce nonuniformities in the subsequent toned image, may be due to the presence of dissolved dye or pigment charge generation material in the CGL, the CTL, or in the CGL/CTL interfacial region. The insoluble form of the pigment comprising the charge generation material can be solubilized during the solvent coating of the CTL over the CGL. The solubilized CGL material will have significant absorption in the visible region in the spectrum, and its presence, even in minute amounts, may cause an increased rate of dark discharge of the surface potential. The present invention, by decreasing the sensitivity of a photoreceptor to photofatigue induced by exposure to visible light, provides an effective solution to this serious problem.

SUMMARY OF THE INVENTION

The present invention is directed to a multi-active electrophotographic charge generation element comprising a conductive support, a charge generation layer (CGL) disposed on the conductive support, and a charge transport layer (CTL) disposed on the charge generation layer. The charge generation layer (CGL) includes a charge-generation material comprising an aggregated or crystalline form of a first dye or pigment and a first polymeric binder. The charge transport layer (CTL) comprises at least one charge-transport agent, a second dye or pigment having absorption in a selected spectral region that at least partially overlaps the absorption of a dissolved non-aggregated or non-crystalline form of the first dye or pigment, and a second polymeric binder. The second dye or pigment in the charge transport layer, which has absorption in the range of about 550–580 nm, absorbs visible radiation in the selected spectral region that is incident on the charge transport layer, thereby shielding the charge generation layer from that radiation and mitigating visible radiation-induced photofatigue.

The electrophotographic charge generation element of the present invention may optionally further include a charge blocking layer disposed between the conductive support and charge generation layer and a protective overcoat layer.

DETAILED DESCRIPTION OF THE INVENTION

In the electrophotographic charge generation element of the present invention, the first polymeric binder in the charge generation layer and the second polymer binder in the charge transport layer are each individually selected from the group of polymers consisting of homopolymers and copolymers of monomeric esters, carbonates, vinylformal, and vinylbutyral. Preferably, the first polymeric binder comprises a polycarbonate, and the second binder comprises a polyester.

Also in the electrophotographic charge generation element of the present invention, the charge generation material is preferably selected from the group consisting of perylenes, azo compounds, pyrylium salts, thiapyrylium salts, squarylium pigments, and metal-free or metallized phthalocyanines. A pigment often exists in a unique state of "aggregation"; for example, a phthalocyanine pigment may exist in a specific "form" or "phase". Certain dyes, on the other hand, thiapyrylium salts, for example, may form a "dye-polymer aggregate" with a binder polymer such as a polycarbonate. The aggregated or crystalline forms of dyes or pigments that find use as photoreceptors are often characterized by a bathochromic shift and a broadened spectral curve relative to the "molecular" species that is dissolved in a polymeric or solvent medium.

In accordance with the present invention, the electrophotographic charge generation element includes a charge generation layer (CGL) that is preferably formed from a mixture comprising polycarbonate, poly(ethylene-co-2,2-dimethylpropylene terephthalate), 1,1-bis-[4-(di-4-tolylamino)phenyl]cyclohexane, diphenylbis-(4-diethylaminophenyl)-methane, 4-(4-dimethylaminophenyl)-2,6-diphenylthiapyrylium hexafluorophosphate, 4-(4-dimethylaminophenyl)-2-(4-ethoxyphenyl)-6-phenylthiapyrylium fluoroborate, and an aggregate "seed" that is a dried paste prepared from a previous batch of the aforementioned mixture.

In addition to aggregated or crystalline charge-generation material, small amounts of dissolved molecular charge-generation material may also be present in a photoreceptor and may be detectable as a peak or shoulder in its absorption spectrum. It is likely that the dissolution of some dye-polymer aggregate or pigment occurs when the CGL is overcoated with the CTL solution. During the overcoating process, the CGL is partially dissolved, and intermixing of the CGL and CTL occurs. This intermixing is desirable to some degree to ensure adequate adhesion and "electrical" contact between these two layers. It is proposed, however, that the presence of dissolved molecular charge-generation material in the CGL, the CTL, and/or in this interfacial region has a previously unrecognized consequence: absorption of visible light by the molecular species, leading to photofatigue characterized by increased dark decay.

It has been unexpectedly found that certain dyes or combination of dyes, with an absorption spectrum overlapping that of the dissolved molecular charge-generation material, will prevent photofatigue of an electrophotographic element, with no change in the photoelectrical or cycling characteristics of the photoreceptor.

In accordance with the present invention, the CTL comprises a charge-transport agent selected from the group consisting of arylamines, hydrazones, arylmethanes, and mixtures thereof. Preferably, the charge-transport agent is selected from the group consisting of tertiary arylamines, tetraarylmethanes, and mixtures thereof. More preferably, the charge transport agent is selected from the group consisting of tertiary arylamines, tetraarylmethanes, and mixtures thereof. Most preferably, the charge transport agent is a tertiary arylamine selected from the group consisting of 1,1-bis-[4-(di-4-tolylamino)phenyl]cyclohexane, tri-(4-tolyl)amine, diphenylbis-(4-diethylaminophenyl)-methane, and mixtures thereof.

Also in accordance with the present invention, the CTL is preferably formed from a mixture comprising poly[4,4'-isopropylidene bisphenylene-co-4,4'-hexafluoroisopropylidene bisphenylene (75/25) terephthalate-co-azelate (65/35)], 1,1-bis-[4-(di-4-tolylamino)phenyl]cyclohexane, tri-(4-tolyl)amine, and diphenylbis-(4-diethylaminophenyl)-methane.

Further in accordance with the present invention, the CTL includes a second dye or pigment having absorption in a selected spectral region that preferably includes the visible region. The second dye or pigment must have an oxidation potential equal to or greater than that of the charge transport material(s) of the CTL to avoid charge trapping effects, and it must not undergo photoinduced electron transfer (charge separation) with any of the CTL components. In accordance with the present invention, photofatigue caused by absorption of light by dissolved molecular dyes or pigments in the CGL, the CTL, or in the CGL-CTL interfacial region can be reduced by including in the CTL a material that selectively absorbs, or filters, light that would otherwise be absorbed by the dissolved molecular species in the CGL, the CTL, or at the CGL-GTL interface. Materials useful for this purpose must meet several criteria, such as the following:

1) ready availability
2) solubility in the CTL coating solvent
3) solubility in the CTL binder polymer at the concentrations utilized
4) absorption spectrum (absorption maximum and bandwidth) similar to that of the dissolved molecular form of the CGL material
5) an excited state that neither emits light or undergoes photochemistry, i.e., a rapid rate of internal conversion
6) an oxidation potential equal to or greater than any of the CTL transport materials
7) cause no changes in the photoelectrical or cycling characteristics of the photoreceptor The following tests were carried out to determine the effect of room light on an electrophotographic element, which preferably includes a metallic or a metallized polymeric support:

Films were exposed for 20 minutes to cool white fluorescent light of an intensity of 120 foot-candles. Immediately following this exposure, the element was compared with a non-exposed sample of the same film by corona charging the elements to an initial potential $V_o$ of approximately −500 volts, exposing the films with a 680 nm exposure, erasing any remaining voltage on the film, and recharging. The cycle simulates the electrical cycling of an electrophotographic element in a photocopier. This cycle was repeated 1,000 times. The difference in initial voltage between the room light exposed film and the unexposed film was calculated for each cycle ($\Delta V_o$). The results for a dye-polymer aggregate CGL are recorded in TABLE 1 following:

TABLE 1

| | Difference in initial voltage $V_o$ between film unexposed to light and film exposed to cool white fluorescent light for 20 minutes. | | | |
|---|---|---|---|---|
| Example | $\Delta V_o$ (10 cycles) | $\Delta V_o$ (100 cycles) | $\Delta V_o$ (500 cycles) | $\Delta V_o$ (1000 cycles) |
| Comp. Ex. 1 | 59 | 54 | 54 | 40 |

Ideally, there would be no change in $V_o$ between the room light exposed element and the unexposed element. As may be seen from Table 1, the magnitude of $\Delta V_o$ does decrease somewhat with cycling (59V to 40V from 10 to 1000 cycles). Where $\Delta V_o$ is large, objectionable imaging defects may be produced. The aim is to reduce $\Delta V_o$ to as near zero as possible.

Through offline experiments using Wratten band-pass filters to isolate selected wavelength regions, it was determined that the wavelengths of light in the range 400–580 nm induce the observed photofatigue. From the action spectrum of photofatigue determined by monitoring the dark decay rate, after exposure to light through narrow band-pass filters, it was found that the greatest effect was caused by incident light at a wavelength of ~550–580 nm.

In a CGL containing a thiapyrylium salt as the dye and a polycarbonate as a component of the polymeric binder, the thiapyrylium salt-polycarbonate aggregate has an absorption maximum at 680 nm, with a shoulder at ~600 nm. A further weak absorption is observed at ~550 nm, which is ascribed to non-aggregated dye that is dissolved in the polymeric binder (The non-aggregated dye dissolved in the binder has an absorption maximum in at ~575 nm, with width at ½ height of ~100 nm.) It is hypothesized that absorption of light by the non-aggregated dye leads to the observed photofatigue. One possible mechanism entails photoinduced electron transfer to the dye from the transport material dopant. With subsequent corona charging, the holes are free to transport to the CTL, but the electrons are to some extent "trapped" on the dye molecules. High dark decay is caused by either the mobile holes or the trapped electrons. By incorporating compounds into the CTL that have an absorption maximum in the 400–580 nm region, it is possible to shield the underlying photoreceptor from the deleterious effect of the incident light, without the need for changing the composition of the CGL.

A variety of compounds have been incorporated into the CTL, and their effect on $\Delta V_o$ has been examined using the previously described test. The results are summarized in TABLE 2 following:

TABLE 2

| | Difference in initial voltage $V_o$ between film unexposed to light and film exposed to cool white fluorescent light for 20 minutes | | | |
|---|---|---|---|---|
| Example | $\Delta V_o$ (10 cycles) | $\Delta V_o$ (100 cycles) | $\Delta V_o$ (500 cycles) | $\Delta V_o$ (1000 cycles) |
| Comp. Ex. 1 | 59 | 54 | 54 | 40 |
| Example 1 | 39 | 35 | 34 | 24 |
| Example 2 | 29 | 33 | 17 | 15 |
| Example 3 | 32 | 32 | 15 | 11 |
| Example 4 | 18 | 18 | 5 | 0 |
| Example 5 | 16 | 16 | 7 | 5 |
| Example 6 | 22 | 20 | 11 | 8 |
| Example 7 | 8 | 7 | −3 | −1 |
| Example 8 | 22 | 14 | 9 | 4 |
| Example 9 | 43 | 40 | 29 | 22 |
| Example 10 | 17 | 22 | 8 | 3 |
| Example 11 | 10 | 7 | −3 | −8 |

Obviously, the most useful examples are those elements where the $\Delta V_o$ is reduced to close to zero in as few cycles as possible. All of the examples in TABLE 2, however, represent significant and useful improvements over the Comparative Example.

Preferred dyes for inclusion in the CTL are BAYSCRIPT® Special Red NT 930601 dye (structure Ia below), BAYSCRIPT® Special Red T dye (structure Ib below), and Disperse Red 1 dye (structure II below), and mixtures of these dyes.

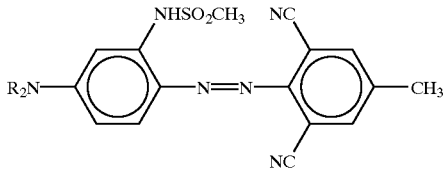

Ia R = Et
Ib R = Pr

II

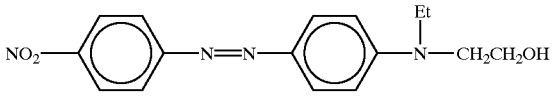

Following are the procedures for preparation of the examples included in TABLE 2:

COMPARATIVE EXAMPLE 1

A multi-active photoconductive film comprising a conductive support, a charge generation layer (CGL), and a charge transport layer (CTL), coated in that order, was prepared from the following compositions under the described conditions.

Coated on 5-mil nickelized poly(ethylene terephthalate) support at a dry coverage of 0.61 g/ft$^2$ was a charge generation layer, with the coating mixture comprising 45.2 wt % polycarbonate (MAKROLON 5705™), 4.48 wt % poly(ethylene-co-2,2-dimethylpropylene terephthalate), 35.8 wt % 1,1-bis-[4-(di-4-tolylamino)phenyl]cyclohexane, 0.69 wt % diphenylbis-(4-diethylamino-phenyl)methane, 5.85 wt % 4-(4-dimethylaminophenyl)-2,6-diphenylthiapyrylium hexafluorophosphate, 1.44 wt % 4-(4-dimethylaminophenyl)-2-(4-ethoxyphenyl)-6-phenylthiapyrylium fluoroborate, and 6.49 wt % of aggregate "seed" (a dried paste of the above charge generation layer mixture that had been previously prepared). The charge generation layer mixture was prepared at 9 wt. % in a 50/50 (wt/wt) mixture of dichloromethane and 1,1,2-trichloroethane. A coating surfactant, DC510, was added at a concentration of 0.01 wt % of the total charge generation layer mixture. The mixture was filtered prior to coating with a 0.6 micron filter.

A charge transport layer was coated onto the charge generation layer at a dry coverage of 2.25 g/ft$^2$. The charge transport layer mixture comprised 69 wt % poly[4,4'-isopropylidene bisphenylene-co-4,4'-hexafluoroisopropylidene bisphenylene (75/25) terephthalate-co-azelate (65/35)], 19.75 wt % 1,1-bis-[4-(di-4-tolylamino)phenyl]cyclohexane, 19.5 wt % tri-(4-tolyl)amine, and 0.75 wt % diphenylbis-(4-diethylaminophenyl)methane. The charge transport layer mixture was prepared at 10 wt % in a 70/30 (wt/wt) mixture of dichloromethane and methyl acetate. A coating surfactant, DC510, was added at a concentration of 0.024 wt % of the total charge transport layer mixture. TEFLON® beads were added to the solution as a friction aid.

EXAMPLE 1

A multi-active photoconductive film was prepared as in Comparative Example 1, except that the charge transport layer comprised 59.6 wt % poly[4,4'-isopropylidene bisphenylene-co-4,4'-hexafluoroisopropylidene bisphenylene (75/25) terephthalate-co-azelate (65/35)], 19.66 wt % 1,1-bis-[4-(di-4-tolylamino)phenyl]cyclohexane, 19.4 wt % tri-(4-tolyl)amine, 0.695 wt % diphenylbis-(4-diethylaminophenyl)methane, and 0.695 wt % BAYSCRIPT® Special Red NT 930601 dye (available from Miles Chemicals Co.).

EXAMPLE 2

A multi-active photoconductive film was prepared as in Comparative Example 1, except that the charge transport layer comprised 59.2 wt % poly[4,4'-isopropylidene bisphenylene-co-4,4'-hexafluoroisopropylidene bisphenylene (75/25) terephthalate-co-azelate (65/35)], 19.53 wt % 1,1-bis-[4-(di-4-tolylamino)phenyl]cyclohexane, 19.2 wt % tri-(4-tolyl)amine, 0.69 wt % diphenylbis-(4-diethylaminophenyl)methane, and 1.4 wt % BAYSCRIPT® Special Red NT 930601 dye.

EXAMPLE 3

A multi-active photoconductive film was prepared as in Comparative Example 1, except that the charge transport layer comprised 59.5 wt % poly[4,4'-isopropylidene bisphenylene-co-4,4'-hexafluoroisopropylidene bisphenylene (75/25) terephthalate-co-azelate (65/35)], 19.65 wt % 1,1-bis-[4-(di-4-tolylamino)phenyl]cyclohexane, 19.35 wt % tri-(4-tolyl)amine, 0.695 wt % diphenylbis-(4-diethylaminophenyl)methane, and 0.78 wt % BAYSCRIPT® Special Red T dye (available from Miles Chemical Company).

EXAMPLE 4

A multi-active photoconductive film was prepared as in Comparative Example 1, except that the charge transport layer comprised 59.1 wt % poly[4,4'-isopropylidene bisphenylene-co-4,4'-hexafluoroisopropylidene bisphenylene (75/25) terephthalate-co-azelate (65/35)], 19.5 wt % 1,1-bis-[4-(di-4-tolylamino)phenyl]cyclohexane, 19.2 wt % tri-(4-tolyl)amine, 0.69 wt % diphenylbis-(4-diethylaminophenyl)methane, and 1.56 wt % BAYSCRIPT® Special Red T dye.

EXAMPLE 5

A multi-active photoconductive film was prepared as in Comparative Example 1, except that the charge transport layer comprised 59.6 wt % poly[4,4'-isopropylidene bisphenylene-co-4,4'-hexafluoroisopropylidene bisphenylene (75/25) terephthalate-co-azelate (65/35)], 19.66 wt % 1,1-bis-[4-(di-4-tolylamino)phenyl]cyclohexane, 19.36 wt % tri-(4-tolyl)amine, 0.695 wt % diphenylbis-(4-diethylaminophenyl)methane, and 0.73 wt % Disperse Red 1 dye, available from Aldrich Chemical Company.

EXAMPLE 6

A multi-active photoconductive film was prepared as in Comparative Example 1, except that the charge transport layer comprised 59.3 wt % poly[4,4'-isopropylidene bisphenylene-co-4,4'-hexafluoroisopropylidene bisphenylene (75/25) terephthalate-co-azelate (65/35)], 19.56 wt % 1,1-bis-[4-(di-4-tolylamino)phenyl]cyclohexane, 19.26 wt % tri-(4-tolyl)amine, 0.69 wt % diphenylbis-(4-diethylaminophenyl)methane, and 1.0 wt % Disperse Red 1 dye and 0.25 wt. % BAYSCRIPT® Special Red NT 930601 dye.

EXAMPLE 7

A multi-active photoconductive film was prepared as in Comparative Example 1, except that the charge transport layer comprised 59.1 wt % poly[4,4'-isopropylidene bisphenylene-co-4,4'-hexafluoroisopropylidene bisphenylene (75/25) terephthalate-co-azelate (65/35)], 19.5 wt % 1,1-bis-[4-(di-4-tolylamino)phenyl]cyclohexane, 19.2 wt % tri-(4-tolyl)amine, 0.69 wt % diphenylbis-(4-diethylaminophenyl)methane, and 1.0 wt % Disperse Red 1 dye and 0.5 wt. % BAYSCRIPT® Special Red NT 930601 dye.

EXAMPLE 8

A multi-active photoconductive film was prepared as in Comparative Example 1, except that the charge transport layer comprised 59.1 wt % poly[4,4'-isopropylidene bisphenylene-co-4,4'-hexafluoroisopropylidene bisphenylene (75/25) terephthalate-co-azelate (65/35)], 19.5 wt % 1,1-bis-[4-(di-4-tolylamino)phenyl]cyclohexane, 19.2 wt % tri-(4-tolyl)amine, 0.69 wt % diphenylbis-(4-diethylaminophenyl)methane, and 1.0 wt % Disperse Red 1 dye and 0.525 wt. % BAYSCRIPT® Special Red T dye.

EXAMPLE 9

A multi-active photoconductive film was prepared as in Comparative Example 1, except that the charge transport layer comprised 59.4 wt % poly[4,4'-isopropylidene bisphenylene-co-4,4'-hexafluoroisopropylidene bisphenylene (75/25) terephthalate-co-azelate (65/35)]. 19.6 wt % 1,1-bis-[4-(di-4-tolylamino)phenyl]cyclohexane, 19.3 wt % tri-(4-tolyl)amine, 0.69 wt % diphenylbis-(4-diethylaminophenyl)methane, and 0.48 wt % Disperse Red 1 dye and 0.5 wt. % BAYSCRIPT® Special Red NT dye 930601.

EXAMPLE 10

A multi-active photoconductive film was prepared as in Comparative Example 1, except that the charge transport layer comprised 59.4 wt % poly[4,4'-isopropylidene bisphenylene-co-4,4'-hexafluoroisopropylidene bisphenylene (75/25) terephthalate-co-azelate (65/35)], 19.6 wt % 1,1-bis-[4-(di-4-tolylamino)phenyl]cyclohexane, 19.3 wt % tri-(4-tolyl)amine, 0.69 wt % diphenylbis-(4-diethylaminophenyl)methane, and 0.48 wt % Disperse Red 1 dye and 0.53 wt % BAYSCRIPT® Special Red T dye.

EXAMPLE 11

A multi-active photoconductive film was prepared as in Comparative Example 1, except that the charge transport layer comprised 59.2 wt % poly[4,4'-isopropylidene bisphenylene-co-4,4'-hexafluoroisopropylidene bisphenylene (75/25) terephthalate-co-azelate (65/35)], 19.5 wt % 1,1-bis-[4-(di-4-tolylamino)phenyl]cyclohexane, 19.2 wt % tri-(4-tolyl)amine, 0.69 wt % diphenylbis-(4-diethylaminophenyl)methane, and 0.48 wt % Disperse Red 1 dye and 0.92 wt % BAYSCRIPT® Special Red NT 930601 dye.

The invention has been described in detail with particular reference to certain preferred embodiments thereof, but it is understood that variations and modifications can be effected within the spirit and scope of the invention, which is defined by the following claims.

What is claimed is:

1. A multi-active electrophotographic charge generation element comprising:

a conductive support;

a charge generation layer (CGL) disposed on said conductive support, said charge generation layer comprising an aggregated or crystalline form of a first dye or pigment, said aggregated or crystalline form comprising a charge-generation material, and a first polymeric binder; and a charge transport layer (CTL) disposed on said charge generation layer, said charge transport layer comprising at least one charge-transport agent, a second dye or pigment having absorption in a selected spectral region that at least partially overlaps the absorption in said selected spectral region of a dissolved non-aggregated or non-crystalline form of said first dye or pigment, and a second polymeric binder;

wherein said second dye or pigment in the charge transport layer comprises a dye that has absorption in the range of about 550–580 nm and absorbs visible radiation in said selected spectral region incident on said charge transport layer, thereby shielding the charge generation layer from said radiation and mitigating visible radiation-induced photofatigue, said second dye or pigment in said charge transport layer being selected from the group consisting of

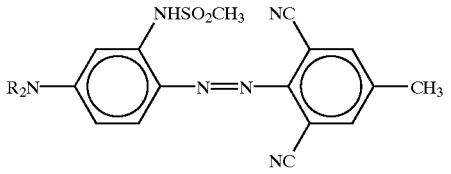

Ia R = Et
Ib R = Pr

II

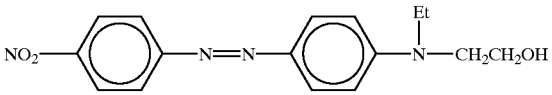

and mixtures thereof.

2. The electrophotographic charge generation element of claim 1 wherein said conductive support is selected from the group consisting of a metallic support and a metallized polymeric support.

3. The electrophotographic charge generation element of claim 2 wherein said conductive support comprises a nickelized poly(ethylene terephthalate) support.

4. The electrophotographic charge generation element of claim 1 wherein said aggregated or crystalline form comprising a charge-generation material is selected from the group consisting of perylenes, azo compounds, pyrylium salts, thiapyrylium salts, squarylium pigments, and metal-free or metallized phthalocyanines.

5. The electrophotographic charge generation element of claim 4 wherein said charge generation layer comprises a charge-generation material comprising a thiapyrylium salt.

6. The electrophotographic charge generation element of claim 5 wherein said thiapyrylium salt is selected from the group consisting of 4-(4-dimethylamino-phenyl)-2,6-diphenylthiapyrylium hexafluorophosphate, 4-(4-dimethylaminophenyl)-2-(4-ethoxyphenyl)-6-phenylthiapyrylium fluoroborate, and mixtures thereof.

7. The electrophotographic charge generation element of claim 6 wherein said charge generation layer is formed from a mixture comprising a first polymeric binder comprising polycarbonate and poly(ethylene-co-2,2-dimethylpropylene terephthalate), a charge-generation material comprising 4-(4-dimethylaminophenyl)-2,6-diphenylthiapyrylium hexafluorophosphate and 4-(4-dimethylaminophenyl)-2-(4-ethoxyphenyl)-6-phenylthiapyrylium fluoroborate, and further including 1,1-bis-[4-(di-4-tolylamino)phenyl] cyclohexane, diphenylbis-(4-diethylaminophenyl)methane, and aggregate seed.

8. The electrophotographic charge generation element of claim 1 wherein said first polymeric binder in said charge generation layer and said second polymeric binder in said charge transport layer is each individually selected from the group of polymers consisting of homopolymers and copolymers of monomeric esters, carbonates, vinylformal, and vinylbutyral.

9. The electrophotographic charge generation element of claim 8 wherein said first polymeric binder comprises a polycarbonate.

10. The electrophotographic charge generation element of claim 9 wherein said first polymeric binder further comprises a polyester.

11. The electrophotographic charge generation element of claim 8 wherein said second polymeric binder comprises a polyester.

12. The electrophotographic charge generation element of claim 1 wherein said charge transport layer comprises a charge-transport agent selected from the group consisting of arylamines, hydrazones, arylmethanes, and mixtures thereof.

13. The electrophotographic charge generation element of claim 12 wherein said charge-transport agent is selected from the group consisting of tertiary arylamines, tetraarylmethanes, and mixtures thereof.

14. The electrophotographic charge generation element of claim 13 wherein said tertiary arylamine is selected from the group consisting of 1,1-bis-[4-(di-4-tolylamino)phenyl] cyclohexane, tri-(4-tolyl)amine, diphenylbis-(4-diethylaminophenyl)methane, and mixtures thereof.

15. The electrophotographic charge generation element of claim 12 wherein said charge transport layer is formed from a mixture comprising a second polymeric binder comprising poly[4,4'-isopropylidene bisphenylene-co-4,4'-hexafluoroisopropylidene bisphenylene (75/25) terephthalate-co-azelate (65/35)] and a change-transport agent comprising, 1,1-bis-[4-(di-4-tolylamino)phenyl] cyclohexane, tri-(4-tolyl)amine, and diphenylbis-(4-diethylaminophenyl)methane.

16. The electrophotographic charge generation element of claim 1 further comprising a charge blocking layer disposed between said conductive support and said charge generation layer.

17. The electrophotographic charge generation element of claim 1 further comprising a protective overcoat layer.

* * * * *